United States Patent [19]

Medeiros et al.

[11] Patent Number: 4,499,756

[45] Date of Patent: Feb. 19, 1985

[54] CONTROL VALVE TEST IN CAM CONTROLLED VALVE SYSTEM

[75] Inventors: Charles W. Medeiros, North Reading; James B. Wagner, Peabody, both of Mass.

[73] Assignee: General Electric Company, Lynn, Mass.

[21] Appl. No.: 498,353

[22] Filed: May 26, 1983

[51] Int. Cl.[3] ..... G01M 15/00

[52] U.S. Cl. ..... 73/118; 60/660

[58] Field of Search ..... 73/116, 118; 60/660, 60/646, 657; 251/211

[56] References Cited

U.S. PATENT DOCUMENTS

| | | | |
|---|---|---|---|
| 3,928,977 | 12/1975 | Braytenbah et al. | 60/660 |
| 4,059,960 | 11/1977 | Osborne | 60/657 X |
| 4,088,875 | 5/1978 | Podolsky et al. | 60/660 X |
| 4,203,297 | 5/1980 | Sakai et al. | 60/660 |

*Primary Examiner*—Jerry W. Myracle

*Attorney, Agent, or Firm*—James W. Mitchell

[57] ABSTRACT

A test apparatus and method tests for closure of ganged, cam operated main control valves in a steam turbine. Cam actuation of a set of upper main control valves is separated from cam actuation of a lower set of main control valves. A test controller actuates one of the sets of main control valves in the opening or closing direction and holds the other set stationary while monitoring turbine power output. When the power output has changed by a predetermined amount, the test controller halts actuation of the first-actuated set of main control valves and begins actuating the other set of main control valves in the opposite direction until the turbine power output has changed a predetermined amount in the opposite direction. The process of incrementally closing one set while incrementally opening the other set of main control valves is continued until the set of main control valves being moved in the closing direction should be fully closed. The amount of steam being fed to the opened set of main control valves indicates whether the closed set of main control valves are, in fact, closed. The test may be continued in the opposite direction by adjusting the previously open main control valves incrementally until they should be fully closed and, between increments of actuation of these main control valves, adjusting the previously closed main control valves in the opening direction until the set being closed should be, in fact, closed.

23 Claims, 11 Drawing Figures

CONTROL VALVE TEST IN CAM CONTROLLED VALVE SYSTEM

BACKGROUND OF THE INVENTION

The present invention relates to steam turbines and, more particularly, to apparatus and method for controlling and testing steam control valves of steam turbines.

The shaft speed or torque of a steam turbine is controlled by a plurality of valves which meter steam into turbine wheels of the steam turbine. The principal control is accomplished by main control valves which control the entry of steam into first-stage nozzles of the high-pressure steam turbine. The first-stage nozzles are customarily divided into a plurality of subsets of nozzles, each supplying steam to an arcuate portion of the first-stage turbine wheel. Each of the subsets of nozzles is fed high-pressure steam from its own main control valve.

Some steam turbine applications such as, for example, commercial electric utility power generation, entail very long periods of operation without plant shutdown for periodic maintenance.

Thus, unsuspected valve failures may occur which can create serious problems when plant shutdown is required. For example, a valve stem may break and prevent closing of the valve. Alternatively, excessive friction may develop in the valve drive apparatus or the valve may become misaligned with its seat thus delaying valve closing or permitting only partial valve sealing respectively. Larger steam turbines employ separate valve actuators for each of the plurality of main control valves. It is thus possible to test closure of each of the main control valves in turn during periods when the full output capability of the steam turbine is not required. Some intermediate-sized steam turbines employ ganged control of a number of the main control valves. For example, a control system disclosed in U.S. Pat. No. 4,082,115, of common assignees with the present invention, employs a single actuator driving a plurality of cams which, in turn, control the positions of three or more valves. The cams are shaped to control steam entry to the first-stage turbine wheel in such a manner that substantially equal turbine output increases are produced for equal cam motion. It should be noted that a substantial non-linearity is built into the cam profiles to achieve such proportional control of turbine load. Valve actuation is sequenced by the cam action so that steam admission begins by opening one of the main control valves and progresses to opening the others in sequence until, at full load, all main control valves participate in supplying steam to the turbine. The shutdown sequence is essentially the inverse of the startup sequence. It would be clear to one skilled in the art that the first valve to be opened in such a cam-controlled valve system is also the last to be closed. Thus, if all of the main control valves are actuated by a single cam control system, only upon complete plant shutdown can closure of the first-opened main control valve be tested.

Some steam turbines separate cam-controlled main control valve actuation into two or more sets rather than a single set. One type of steam turbine, for example, employs two coordinated cam control devices for the concerted operation of six main control valves. Each of the cam control devices sequences the valve actuation for its set of three main control valves. In the startup sequence for the steam turbine, one of the cam control devices begins by opening one of its main control valves. This is followed by the second cam control device beginning opening one of its main control valves. The sequence continues with each cam control device in turn beginning the opening of one of its associated main control valves until all six main control valves are open for feeding steam to their associated subsets of nozzles. The shutdown sequence is essentially the reverse of the startup sequence described in the preceding with the cam control devices completing the closing of each main control valve in turn until the first-opened main control valve is at last closed. Thus, testing of closure of all main control valves can still only be performed in connection with a complete plant shutdown.

OBJECTS AND SUMMARY OF THE INVENTION

Accordingly, it is an object of the invention to provide method and apparatus for testing valves in a steam turbine which overcomes the drawbacks of the prior art.

It is a further object of the invention to provide method and apparatus for testing ganged, cam-operated main control valves in a steam turbine.

It is a still further object of the invention to provide a test controller for incrementally controlling one set of main control valves in the closing direction while controlling the other set of main control valves in the opening direction until the main control valves being controlled in the closing direction should be fully closed. Each set is moved an increment while the other set is held stationary until the turbine power output changes a predetermined amount from a reference value. Then the other set is moved while the first set is held stationary.

According to an embodiment of the invention, there is provided apparatus for testing main control valves in a steam turbine of the type having at least first and second sets of main control valves for admitting steam to the steam turbine and at least first and second cam controls for respectively controlling the first and second sets of main control valves in an actuation sequence, comprising first means for driving the first cam control in first a direction which performs one of opening and closing the first set of main control valves and for maintaining the second cam control stationary until a first change in a first predetermined amount in a first direction is achieved in an output of the steam turbine, second means for driving the second cam control in a second direction which performs the other of opening and closing the second set of main control valves and for maintaining the first cam control stationary until a second change in a second predetermined amount in a second direction opposite to the first direction is achieved in the output of the steam turbine, the first and second means being effective for alternate actuation until the one of the first and second cam controls performing closing of its respective set of main control valves attains a condition in which its related set of main control valves should be in a predetermined condition, and means for determining whether the related set is, in fact, in the predetermined condition.

According to a feature of the invention, there is provided a test controller for testing main control valves in a steam turbine of the type having at least first and second sets of main control valves for admitting steam to the steam turbine and at least first and second cam controls for respectively controlling the first and second sets of main control valves in an actuation sequence, the first and second cam controls including means for independent drive thereof, comprising means for storing a test power reference of the steam turbine at a start of a test, means for producing upper and lower thresholds above and below respectively the test power reference, logic means for driving the independent drive of the first cam control in a first direction to perform one of opening and closing its related set of main control valves while holding the independent drive of the second cam control stationary until the power output changes an amount to one of exceed the upper threshold and become less than the lower threshold and then for holding the first cam control stationary while driving the independent drive of the second cam control in a second direction to perform the other of opening and closing its related set of main control valves until the power output changes an amount to the other of exceed the upper threshold and become less than the lower threshold, the logic means being further effective to continue alternately driving the first and second cam controls while maintaining the power output within the upper and lower thresholds until a predetermined condition of the first and second cam controls should be achieved, and means for determining that the predetermined condition is, in fact, achieved.

According to a further feature of the invention, there is provided, a method for testing main control valves in a steam turbine of the type having at least first and second sets of main control valves for admitting steam to the steam turbine and at least first and second cam controls for respectively controlling the first and second sets of main control valves in an actuation sequence, comprising driving the first cam control in first a direction which performs one of opening and closing the first set of main control valves and maintaining the second cam control stationary until a first change in a first predetermined amount in a first direction is achieved in an output of the steam turbine, driving the second cam control in a second direction which performs the other of opening and closing the second set of main control valves and maintaining the first cam control stationary until a second change in a second predetermined amount in a second direction opposite to the first direction is achieved in the output of the steam turbine, continuing alternately driving the first and second cam controls until the one of the first and second cam controls performing closing of its respective set of main control valves attains a condition in which its related set of main control valves should be in a predetermined condition, and determining whether the related set is, in fact, in the predetermined condition.

According to a still further feature of the invention, there is provided, a method for testing main control valves in a steam turbine of the type having at least first and second sets of main control valves for admitting steam to the steam turbine and at least first and second cam controls for respectively controlling the first and second sets of main control valves in an actuation sequence, the first and second cam controls including means for independent drive thereof, comprising storing a test power reference of the steam turbine at a start of a test, producing upper and lower thresholds above and below respectively the test power reference, driving the independent drive of the first cam control in a first direction to perform one of opening and closing its related set of main control valves while holding the independent drive of the second cam control stationary until the power output changes an amount to one of exceed the upper threshold and become less than the lower threshold and then holding the first cam control stationary while driving the independent drive of the second cam control in a second direction to perform the other of opening and closing its related set of main control valves until the power output changes an amount to the other of exceed the upper threshold and become less than the lower threshold, continuing alternately driving the first and second cam controls while maintaining the power output within the upper and lower thresholds until a predetermined condition of the first and second cam controls should be achieved, and determining that the predetermined condition is, in fact, achieved.

Briefly stated, the present invention provides a test apparatus and method for testing closure of ganged, cam operated main control valves in a steam turbine. In accordance with the invention, cam actuation of a set of upper main control valves is separated from cam actuation of a lower set of main control valves. For main control valve test, means are provided to actuate one of the sets of main control valves in the opening or closing direction while monitoring turbine power output. When the power output has changed by a predetermined amount, the first-actuated set of main control valves is halted and the other set of main control valves is actuated in the opposite direction until the turbine power output has changed a predetermined amount in the opposite direction. The process of incrementally closing one set while incrementally opening the other set is continued until the set of main control valves being moved in the closing direction should be fully closed. The amount of steam being fed to the opened set of main control valves indicates whether the closed set of main control valves are, in fact, closed. The test may be continued in the opposite direction by adjusting the previously opened main control valves incrementally until they should be fully closed and, between increments of actuation of these main control valves, adjusting the previously closed main control valves in the opening direction until the set being closed should be, in fact, closed. A test memory may be provided for baseline data against which present test results may be compared.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
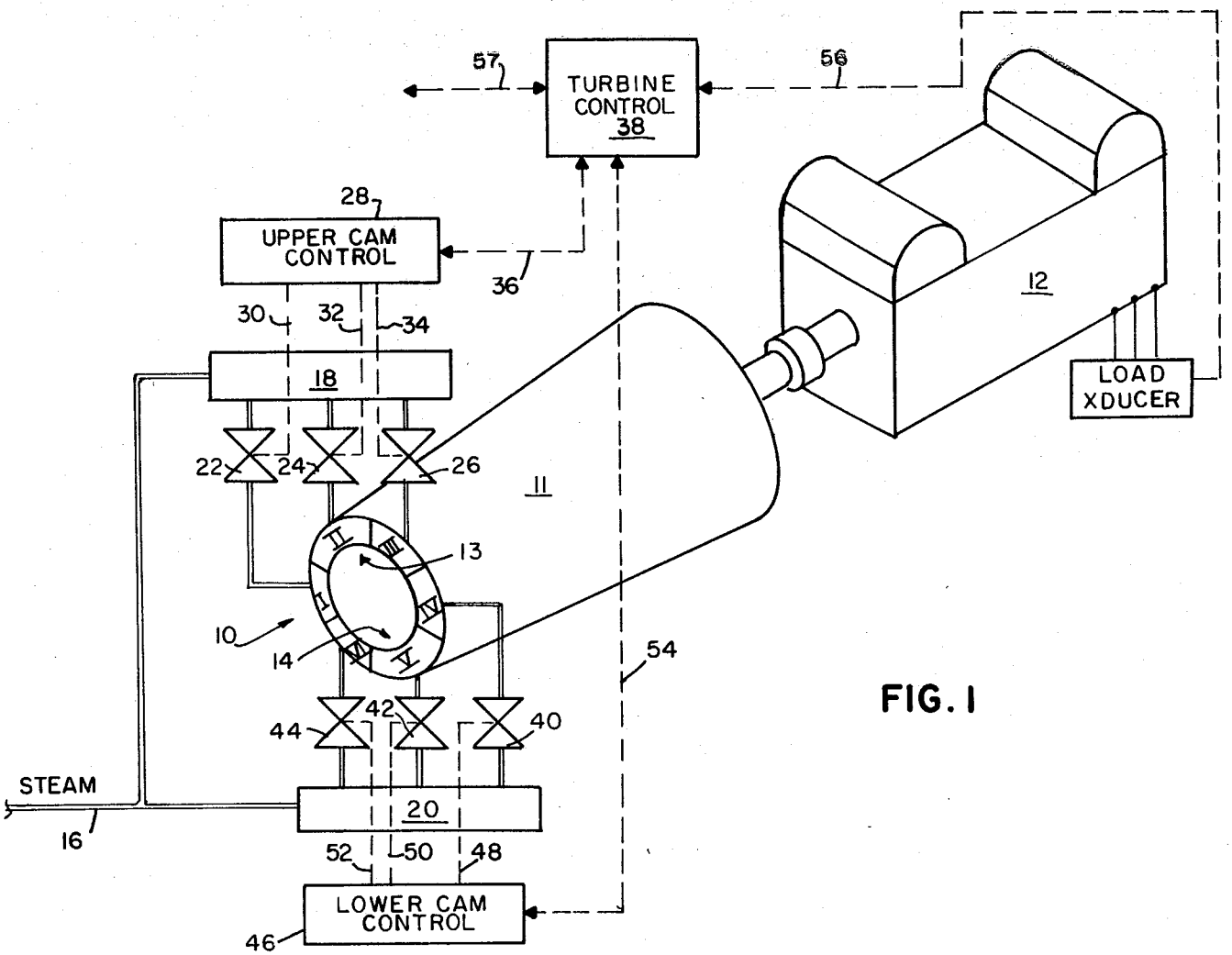
FIG. 1 is a schematic view of a main control valve system for a steam turbine according to an embodiment of the invention.

Referring now to FIG. 1, a highly schematic view is shown of those portions of a steam turbine which are necessary for an understanding of the present invention. An annular arrangement of first-stage nozzles 10 deliver steam to blades or buckets (not shown) of a high-pressure turbine 11 which drives an electric generator 12. First-stage nozzles 10 are divided into a semicircular upper partial arc 13 and a semicircular lower partial arc 14. Semicircular upper partial arc 13 is further subdivided into three nozzle subsets I, II and III. Similarly, lower partial arc 14 is further subdivided into three nozzle subsets IV, V and VI. High-pressure steam is delivered on a line 16 from a conventional boiler (not shown) to an upper steam chest 18 and a lower steam chest 20. Three upper main control valves 22, 24 and 26 control the application of steam from upper steam chest 18 individually to nozzle subsets I, II and III respectively. An upper cam control 28 which may be, for example, similar to a cam controlled valve operator disclosed in U.S. Pat. No. 4,082,115, applies sequenced mechanical actuation on mechanical links 30, 32 and 34 to upper main control valves 22, 24, and 26 respectively. Upper cam control 28 is actuated in response to control signals on a line 36 from a turbine control system 38.

Three lower main control valves 40, 42 and 44 control the application of steam from lower steam chest 20 individually to nozzle subsets IV, V and VI respectively. A lower cam control 46, which is preferably similar to upper cam control 28, applies sequenced mechanical actuation on mechanical links 48, 50 and 52 to lower main control valves 40, 42 and 44 respectively. Lower cam control 46 is actuated in response to control signals on a line 54 from turbine control system 38.

Turbine control system 38 receives a feedback signal on a line 56 indicating the output power of the steam turbine measured, for example, in terms of the output power in watts of an electric generator being driven by the steam turbine.

For completeness, turbine control system 38 is shown connected to a line 57 on which it provides control signals to, and receives command and feedback signals from, other portions of the steam turbine. It is assumed for the purpose of the present invention that the remainder of the steam turbine is conventional and not requiring description for a full disclosure of the present invention. Thus, beyond indicating that control system 38 interacts with such other portions of the steam turbine, further discussion thereof is omitted.

During normal operation, upper cam control 28 and lower cam control 46 are concertedly driven to provide substantially linear increases and decreases in turbine loading. In order to accomplish such linear drive, cam profiles in upper and lower cam controls 28 and 46 are shaped to produce substantially the inverse of the conventional valve characteristic of upper and lower main control valves 22, 24, 26, 40, 42 and 44. That is, the conventional valve characteristic which provides as much as 90 percent of steam delivery upon about 40 percent of valve travel is counteracted by cam profiles which are shaped to initially open the related valve only a small amount for a given cam rotation following crack-open and to increase the rate of opening for a given cam rotation as the valve becomes more fully opened. It is the availability of such a linearizing effect with relatively straightforward hardware which serves as the motivation for providing such cam control devices.

Lines 36 and 54 are shown double-headed to indicate that feedback signals indicating, for example, cam positions and valve actuator hydraulic pressures may be fed back from upper and lower cam controls 28 and 46 to turbine control system 38.

Figure 2:
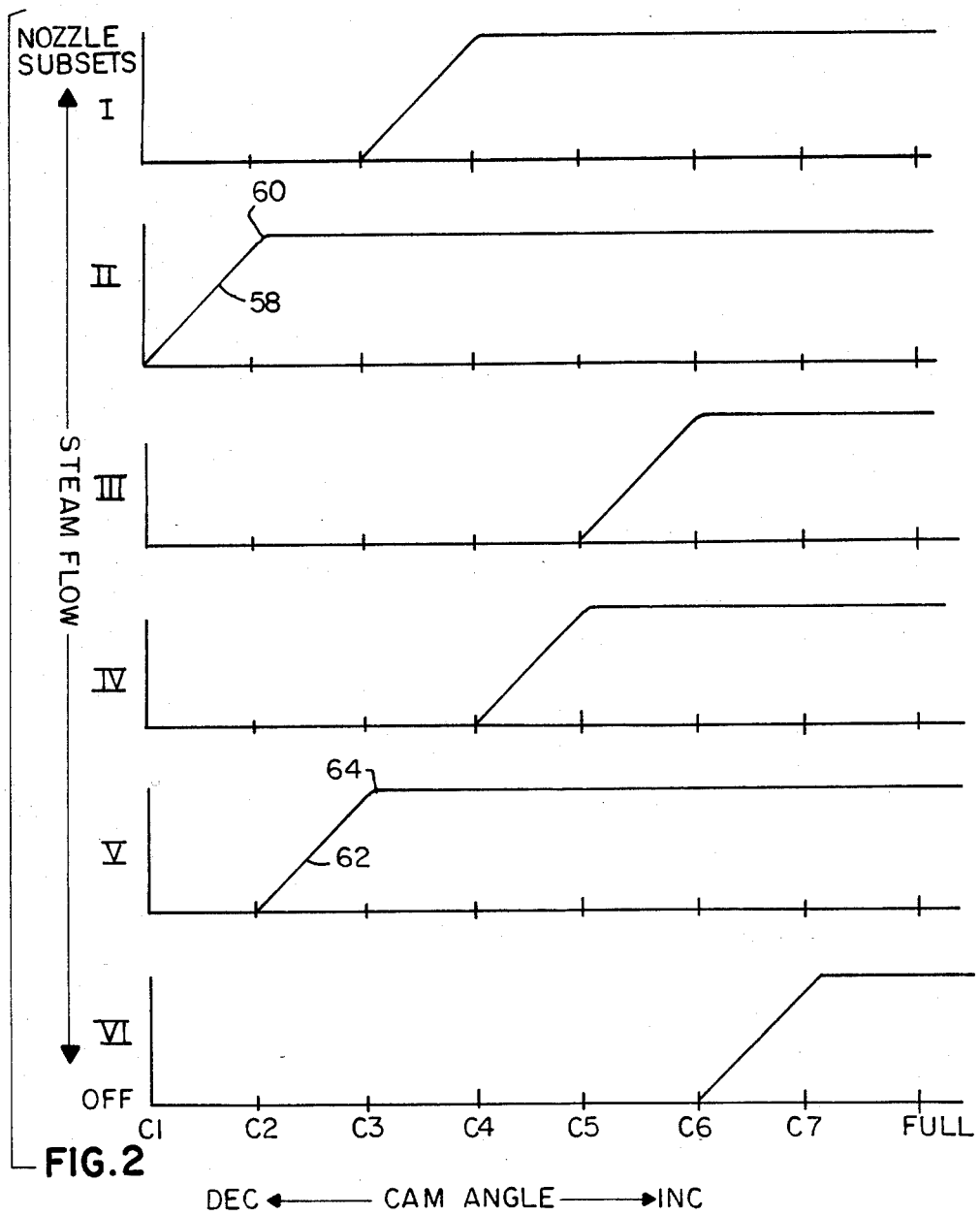
FIG. 2 is a series of curves showing the individual contribution to steam mass flow rate of the nozzle subsets of FIG. 1 as a function of control cam angle.

Referring now also to FIG. 2, there is shown one possible pattern for normal concerted actuation of upper and lower main control valves 22, 24, 26, 40, 42 and 44 supplying steam to nozzle subsets I–VI respectively during a startup sequence beginning at a left-hand portion of FIG. 2 where all steam is cut off and ending at a right-hand portion where steam is fully turned on to all six nozzle subsets. The horizontal axis of FIG. 2 is in units of rotation of the cams (not shown) in upper and lower cam controls 28 and 46 which, for present purposes, can be considered to be mechanically locked together for equi-angular rotation. The vertical axis represents mass rate of steam flow in pounds per minute. Beginning from the completely off condition at the left of the figure, upper main control valve 24 is cracked and progressively opened to valve steam in a generally linear ramp 58 into nozzle subset II in the center of upper partial arc 13 during a first period C1 of rotation of the cams in upper and lower cam controls 28 and 46. A knee point 60 in the steam delivery through upper main control valve 24 occurs at the end of period C1 when upper main control valve 24 is delivering close to its maximum flow capacity. Upper main control valve 24 continues to open during the following period C2 wherein a slight increase in steam flow through nozzle subset II is obtained and the pressure drop across now fully opened upper main control valve 24 decreases to a minimum.

Coincident with the steam flow through nozzle subset II reaching knee point 60, lower main control valve 42 is cracked and progressively opened to valve steam to nozzle subset V centered in lower partial arc 14 in a generally linear ramp 62 during period C2 of rotation of the cams in upper and lower cam controls 28 and 46. Steam flow through nozzle subset V reaches a knee point 64 at the end of cam rotation period C2. Lower main control valve 42 continues toward fully open during cam rotation period C3.

The next main control valve to be cracked and progressively opened is upper main control valve 22 which supplies steam to nozzle subset I in upper partial arc 13 during cam rotation period C3. Next, lower main control valve 40 is cracked and progressively opened to supply steam to nozzle subset IV which, it will be noted from FIG. 1, lies diametrically opposite nozzle subset I during cam rotation period C4. Finally, upper main control valve 26 is cracked and progressively opened and then lower main control valve 44 is cracked and progressively opened to supply steam, in turn, to nozzle subsets III and VI respectively during cam rotation periods C5 and C6. Lower main control valve 44 continues to be opened during cam rotation period C7 until it is fully opened. At this point, full steam flow is being delivered to first-stage nozzles 10.

Figure 3:
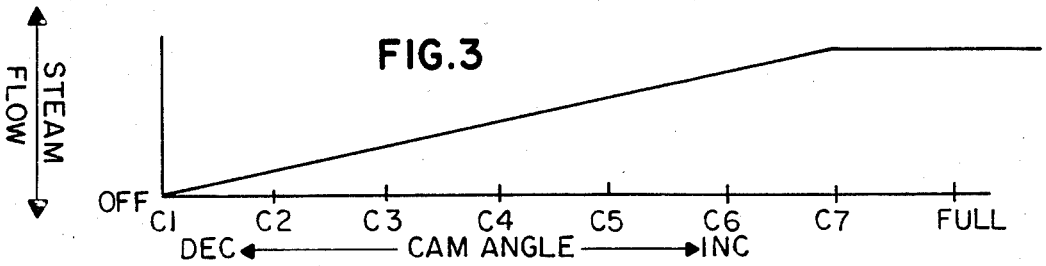
FIG. 3 is a curve showing the total steam flow resulting from the individual contributions of steam mass flow of FIG. 2.

Referring now to FIG. 3, it will be noted that the total mass rate of steam flow during cam rotation periods C1 through C6 is a generally continuous ramp. Each succeeding valve actuation is sequenced to begin just as the next-preceding valve becomes incapable of continuing its linear increase in steam flow.

The above description represents the normal sequence of feeding steam to first-stage nozzles 10 from fully off to fully on in which upper and lower cam controls 28 and 46 can be considered locked together for concerted rotation. However, in accordance with an embodiment of the invention, turbine control system 38 is capable of separately and independently controlling actuation of upper and lower cam controls 28 and 46 for test purposes. Due to the cam sequencing for normal operation the one-to-one correspondence between cam rotation and steam flow is destroyed when either upper cam control 28 or lower cam control 46 is operated independently of the other. That is, upper main control valves 22, 24 and 26 are not cracked and opened in a contiguous sequence, but instead, their actuation is separated by intervening actuation of lower main control valves 40, 42 and 44. Thus, if only upper cam control 28 is driven to control steam delivery through nozzle subsets I, II and III, the resulting steam flow is angle in the fashion shown in FIG. 4 wherein a linear increase in steam flow takes place during cam rotation period C1 due to the opening of upper main control valve 24 and the consequent increase in steam flow to nozzle subset II. In cam rotation period C2, however, little if any increase in steam flow takes place since this is the period reserved for steam delivery through lower main control valve 42 and nozzle subset V in lower partial arc 14. After a level period 66, steam delivery begins through nozzle subset I for an additional linear ramp 58' during cam rotation period C3 until knee point 60' is encountered at the beginning of cam rotation period C4. Again, steam flow is substantially constant during cam rotation period C4 to be followed by a final linear ramp 58'' during cam rotation period C5.

Figure 4:
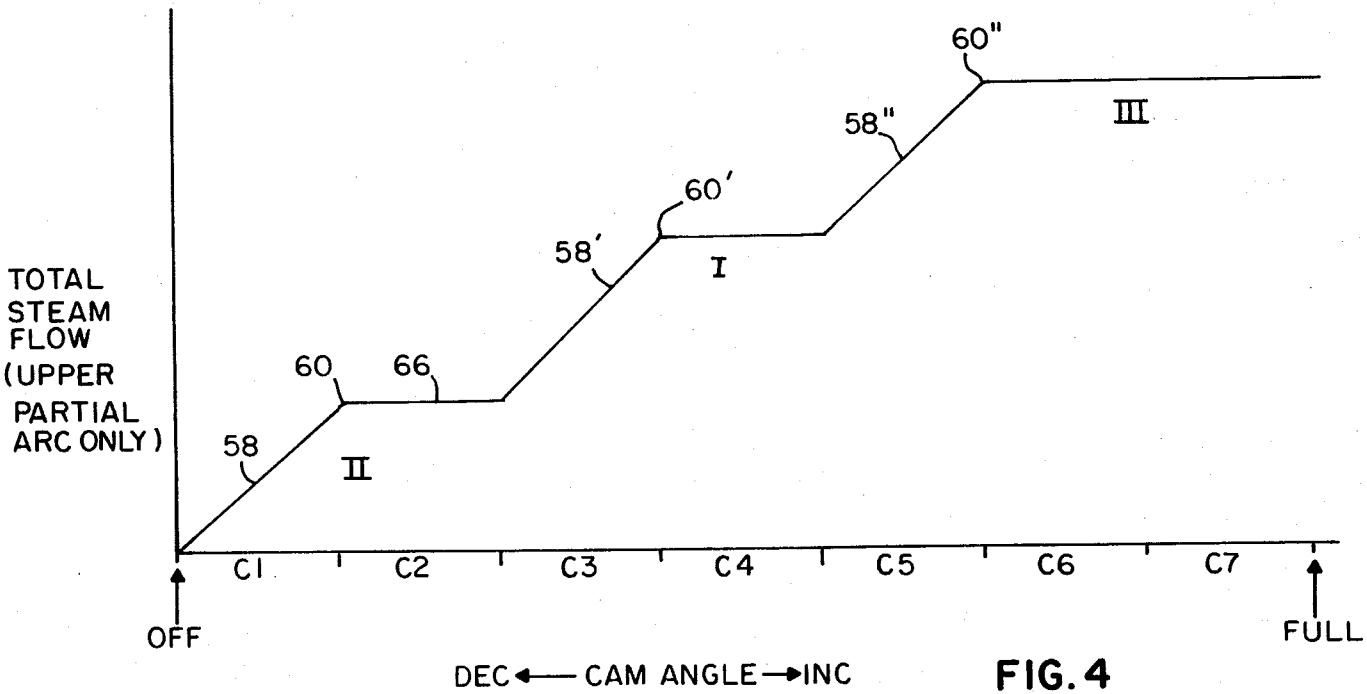
FIG. 4 is a curve showing the total steam flow produced by the nozzle subsets in the upper partial arc of FIG. 1.

The steam flow in response to actuation of lower cam control 46 alone is similar to that shown in FIG. 4 except displaced one cam rotation period to the right.

The inventors have discovered that it is possible to take advantage of the ability to independently control upper cam control 28 and lower cam control 46 to perform main control valve testing on a steam turbine under load. In general, the load must be less than half the maximum turbine load. That is, in normal operation with concerted locked rotation of the cams in upper cam control 28 and lower cam control 46, cam rotation is somewhere in cam rotation periods C1, C2 or C3. If the turbine load is just below on-half maximum load, cam rotation is in cam rotation period C3 with upper main control valve 24 and lower main control valve 42 fully opened to deliver maximum steam flow to nozzle subsets II and V and upper main control valve 22 partially throttled to deliver less than maximum flow to nozzle subset I.

Testing may be performed under either manual or automatic control. One of upper cam control 28 or lower cam control 46 is actuated in the closing direction while the generator output power being fed back on line 56 to turbine control system 38 is monitored for change. When the output power has decreased a predetermined amount such as, for example, by about five percent, the actuation in the closing direction is halted and the other of the cam controls is actuated in the opening direction while the output power is again monitored for increase. When the output power increases by a predetermined amount such as, for example, by about five percent over the original power output, motion in the increasing direction is stopped. The original cam control is again actuated in the closing direction while again monitoring the output power and is again stopped when the output power decreases to a predetermined amount below the original power output. This process is continued going back and forth between closing one set of main control valves and opening the other set until the set being actuated in the closing direction are fully closed. If one of the set of main control valves or its actuator has suffered a failure or malfunction which prevents it from fully closing and sealing, this fact will be evident from the fact that the set of main control valves being moved in the opening direction are not permitted to attain an open condition which corresponds to the output power being generated.

It will be noted that, in certain regions of cam rotation, a respective cam must be rotated through a relatively large annular region without a change in steam flow being produced. The above-described test control sequence accommodates these non-linearities.

One circuit which may be employed to effect the test procedure described hereinabove is a test controller shown in FIG. 5 generally at 68. Test controller 68 is conveniently contained in turbine control system 38 and is supplied with appropriate signals therein by conventional means. For present purposes, test controller 68 is shown in control of the turbine. One skilled in the art would recognize that a number of other control signals and responses are interfaced with turbine control system 38 which are not necessary to show or describe herein for a full disclosure of the present invention.

Figure 5:
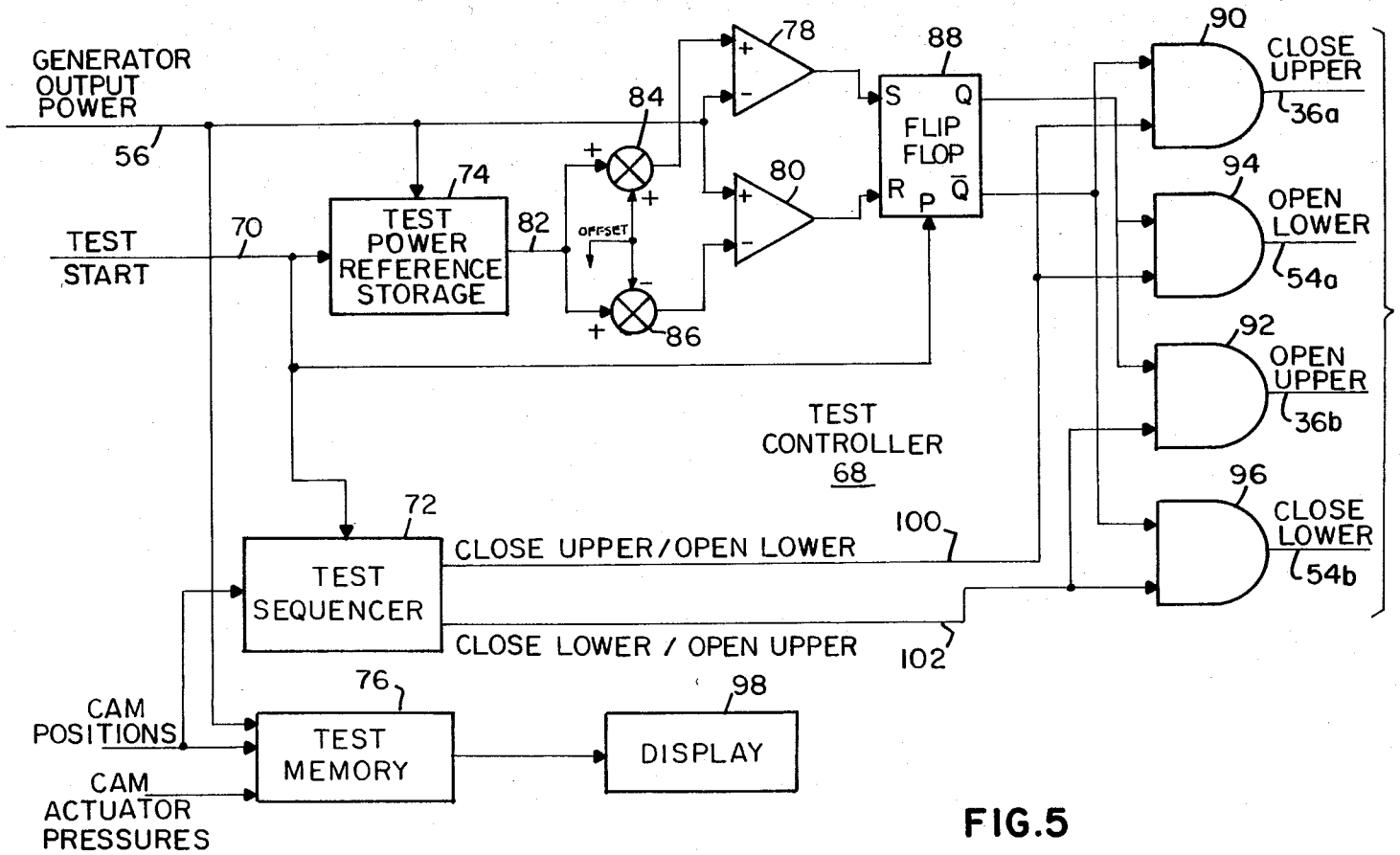
FIG. 5 is a logic diagram of a test controller according to an embodiment of the invention.

Referring to FIG. 5, a test start signal is applied on a line 70 to a test sequencer 72 and to a test power reference storage 74. The test start signal is generated in any convenient way such as, for example, by a manual switch or by a digital processor. The generator output power signal on line 56 is applied to an input of test power reference storage 74, to one input of a test memory 76, to the minus input of a comparator 78 and to the plus input of a second comparator 80.

Test power reference storage 74 stores the value of the generator output power signal existing at the time the test start signal is received and applies this value on a line 82 to a plus inputs of adders 84 and 86. An offset voltage is applied to a second plus input of adder 84 and to a minus input of adder 86. The output of adder 84 is applied to the plus input of comparator 78. The output of adder 86 is applied to the minus input of comparator 80. The output of comparator 78 is applied to the set input S of a flip flop 88. The output of comparator 80 is applied to the reset input R of flip flop 88. The direct output of flip flop 88 is applied to an input of AND gates 92 and 94. The inverted output of flip flop 88 is applied to an input of AND gates 90 and 96.

A first output of test sequencer 72, commanding closure of upper main control valves 22, 24 and 26 and opening of lower main control valves 40, 42 and 44, is applied on a line 100 to inputs of AND gates 90 and 94. A second output of test sequencer 72, commanding opening of upper main control valves 22, 24 and 26 and closure of lower main control valves 40, 42 and 44 is applied on a line 102 to AND gates 92 and 96.

Test memory 76 also receives cam position and cam actuator pressure feedback signals from lines 36 and 54. Test memory optionally produces an output to a conventional display 98 such as, for example, a cathode ray tube or a printer.

In operation, when a test start signal is received, test power reference storage 74 stores the then-existing value of the generator output power signal on line 56 as a reference for control during the remainder of the test. Adders 84 and 86 respectively add and subtract a value equal to the offset to the stored generator output power signal to produce upper and lower limits, respectively, for control of turbine output. Test sequencer 72 produces a test sequence signal on one of its output lines 100 or 102 which enables one of upper cam control 28 or lower cam control 46 to move its related main control valves in the opening direction and the other to move its main control valves in the closing direction. For concreteness of description, it is assumed that initially a signal is generated on line 100 enabling closure of upper main control valves 22, 24 and 26 and opening of lower main control valves 40, 42 and 44.

The signal on line 100 enables one input of each of AND gates 90 and 94. The other input of one of AND gates 90 and 94 is enabled by an output of flip flop 88. The other input of the other of AND gates 90 and 94 is inhibited by the other output of flip flop 88. Initially, assume that flip flop 88 is reset and that its inverted output enables the second input of AND gate 90. The direct output of flip flop 88 inhibits the second input of AND gate 94. AND gate 90 produces an enable signal on its output line 36*a* which enables upper cam control 28 to begin moving in the closing direction. The inhibit output of AND gate 94 at this time prevents actuation of lower cam control 46.

As soon as closing of one of upper main control valves 22, 24 and 26 has progressed sufficiently that the generator output power signal is reduced to below the lower reference signal applied to comparator 80, the output of comparator 80 switches from high to low. This triggers flip flop 88 into the set condition wherein the enable signal from its inverted output is removed and an enable signal is applied from its direct output to the second input of AND gate 94. The enable signal previously applied on line 36*a* to enable upper cam control 28 to move in a direction to close the upper main control valves is removed and thus closure of the upper main control valves is halted. AND gate 94 produces an enable signal on line 54*a* which enables lower cam control 46 to rotate its cam in a direction to open lower main control valves 40, 42 and 44. This enable signal is maintained until the generator output power signal on line 56 exceeds the upper threshold applied to comparator 78. When the generator output power signal exceeds the upper threshold, the output of comparator 78 switches to low. This resets flip flop 88 thus halting further opening of the lower main control valves and enabling additional closing of the upper main control valves.

The above sequence is continued until the cam position of upper cam control 28 indicates that all of its related upper main control valves should be closed. Given the output power being generated and the position of the cam in lower cam control 46, a comparison of cam position in lower cam control 46 with baseline data in test memory 76 indicates whether all of upper main control valves 22, 24 and 26 are, in fact, closed and sealed. This information can be conveyed to an operator using display 98.

Once closure of the upper main control valves has been confirmed, test sequencer 72 applies an enable signal on line 102 to AND gates 92 and 96. This enable signal enables reversal of the open and closed positions of the upper and lower main control valves until confirmation of the closure and sealing of lower main control valves 40, 42 and 44 is confirmed by the position of the cam in upper cam control 28 at the end of this portion of the sequence.

Other measureable attributes of the turbine during the test sequence can be employed to determine whether correct valve actuation is being achieved. As one indicator of such other attributes, FIG. 5 includes cam actuator pressures being applied to test memory 76. Test memory 76 compares these attributes with baseline values therefor and indicates the presence of abnormalities on display 98.

Baseline data for test memory 76 may be obtained and stored in any convenient manner and medium. For example, test memory 76 may be a digital memory device in which baseline parameters are stored during a baseline run on a new equipment. Alternatively, baseline data may be input according to engineering specifications. In addition, test memory 76 may take the form of a printed document containing the related values of parameters which indicate health or sickness of the apparatus. In this case, the operator compares measured parameters with the data in the printed document to produce the knowledge output.

If relatively comprehensive baseline data is maintained in test memory 76, even finer test results can be obtained. For example, if the expected output power for any combination of cam positions in upper and lower cam controls 28 and 46 is contained in test memory 76, as soon as the affected cam reaches an angular region in which a defective valve should be throttling its respective steam flow, and fails to do so, the comparison in test memory can so indicate. A similar test sensitivity may be achievable for other parameters such as, for example, valve actuator pressure upon the availability of a richer array of baseline data. Such baseline data may take the form of, for example a digitally stored look-up table in test memory whose contents are compared with experience data. Deviations from the baseline data may be taken as indications of one or more faults.

Figure 6:
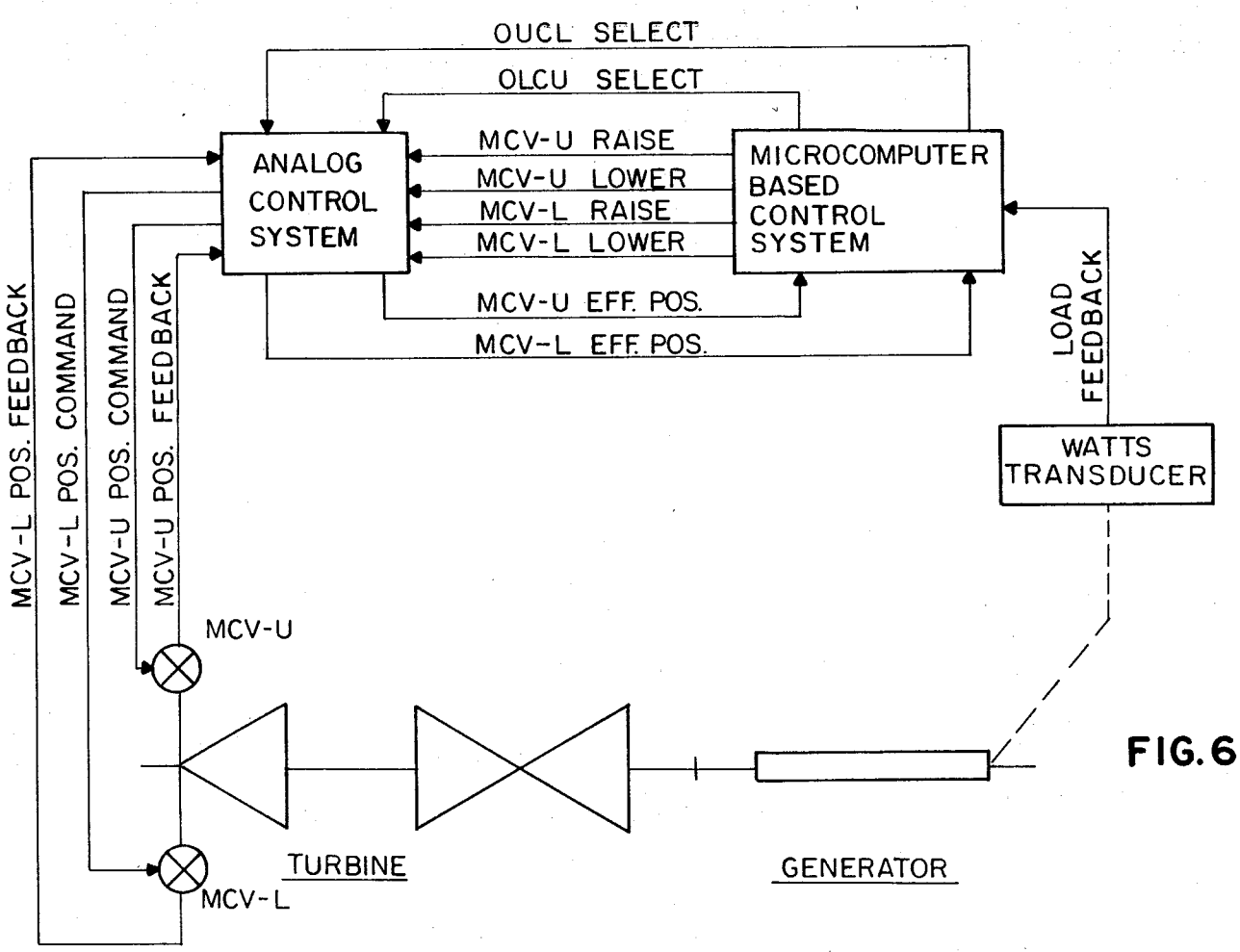
FIG. 6 is a block and schematic diagram illustrating partitioning between digital and analog components according to one embodiment of the invention.
Figure 7A:
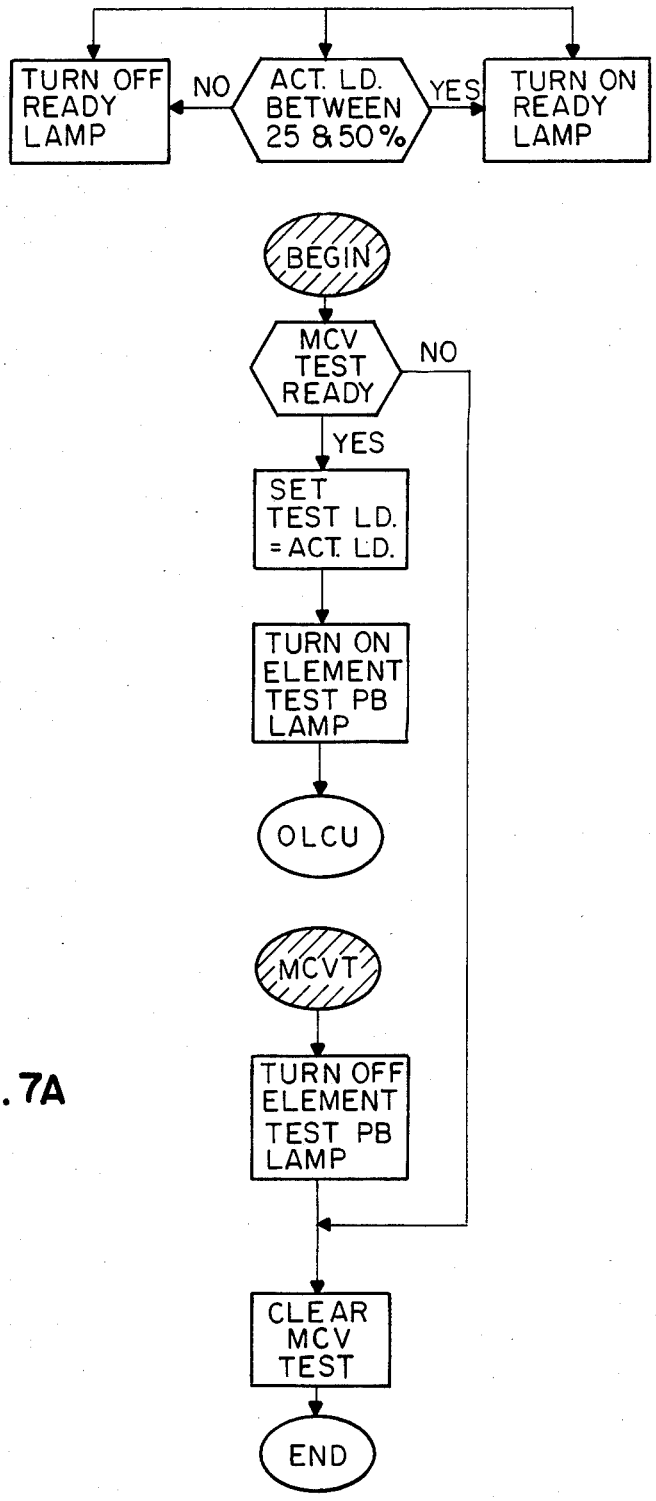
FIGS. 7A-7E are flow charts of a computer program suitable for controlling the digital functions of the invention.
Figure 7B:
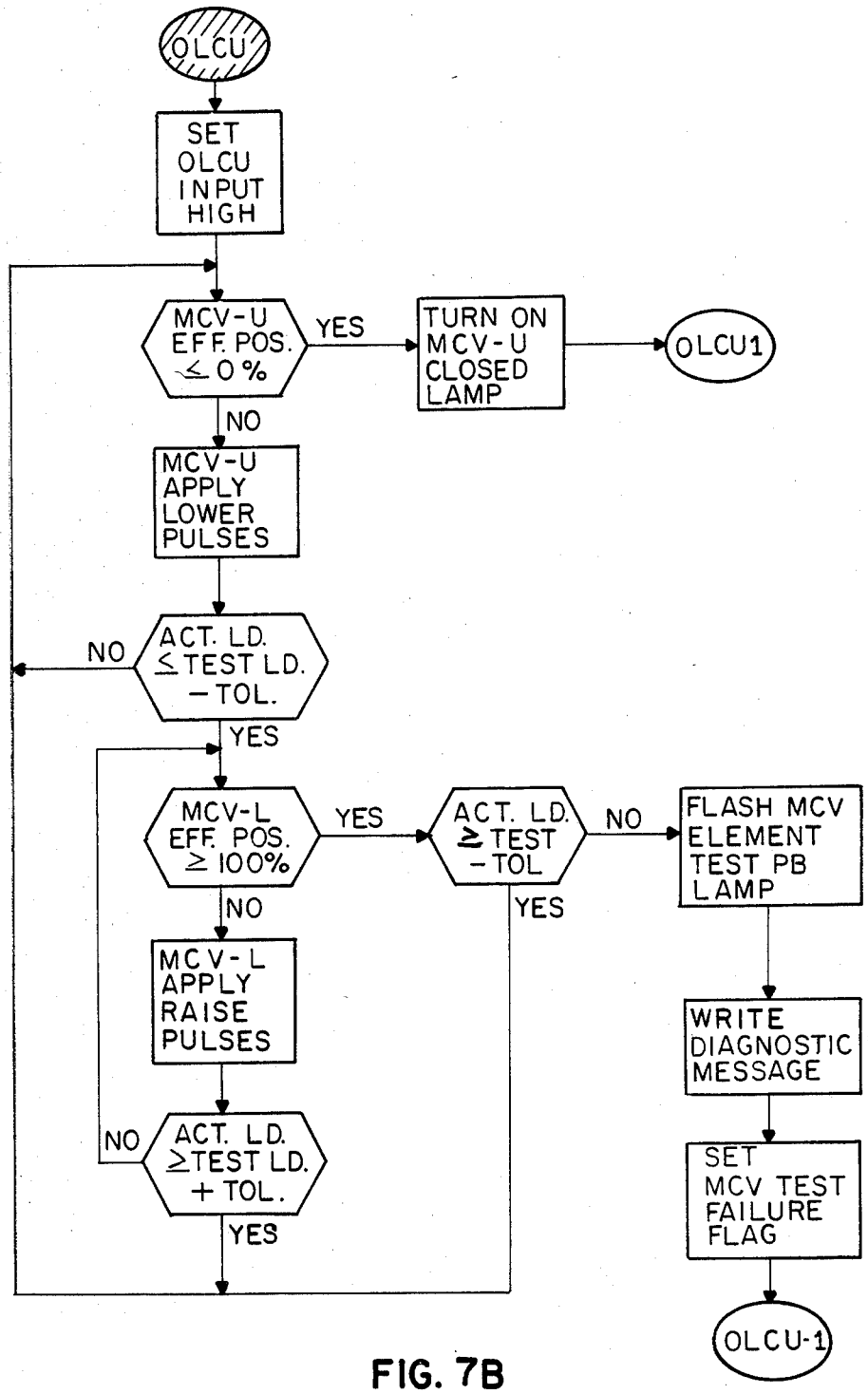
Figure 7C:
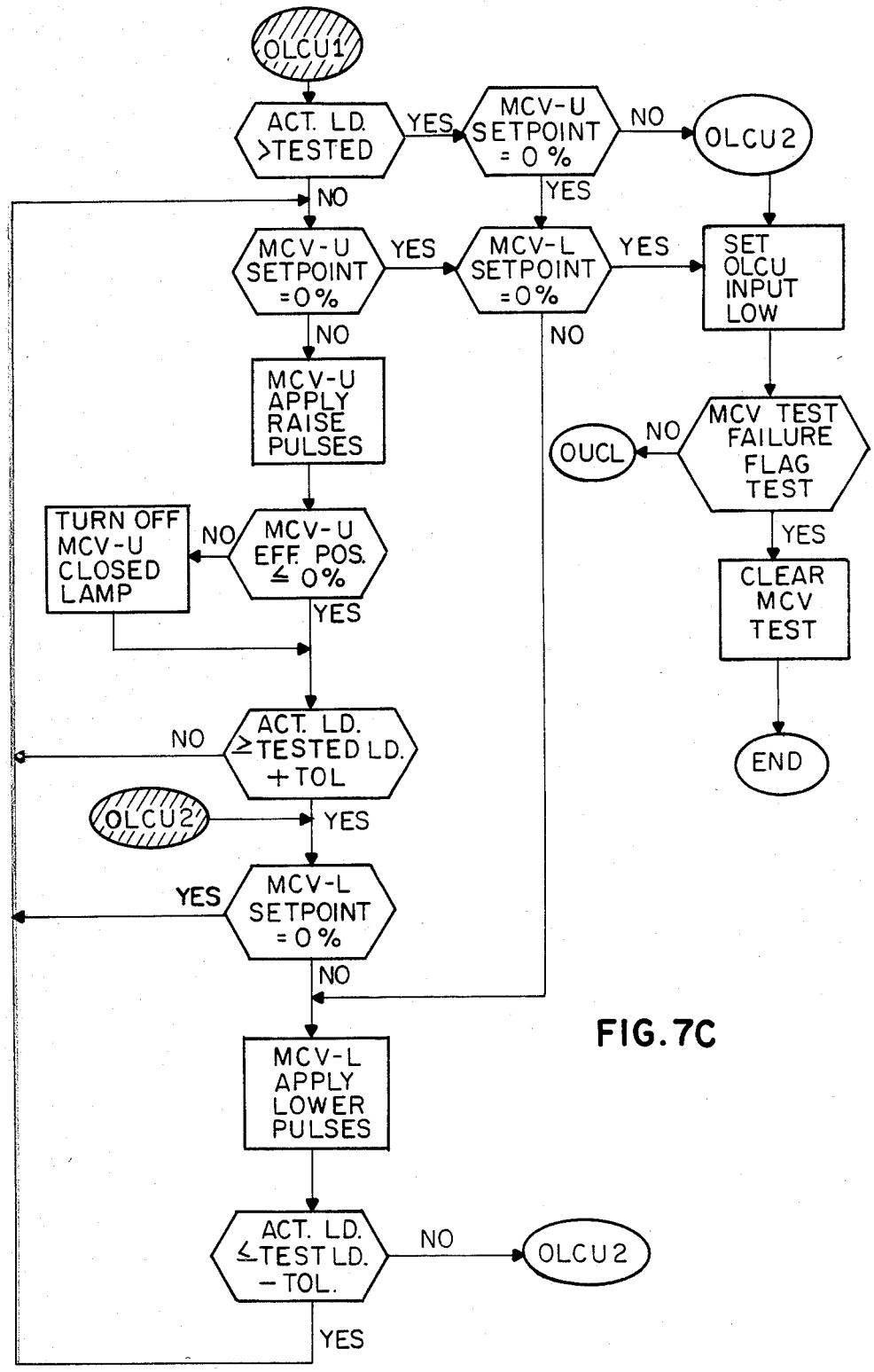
Figure 7D:
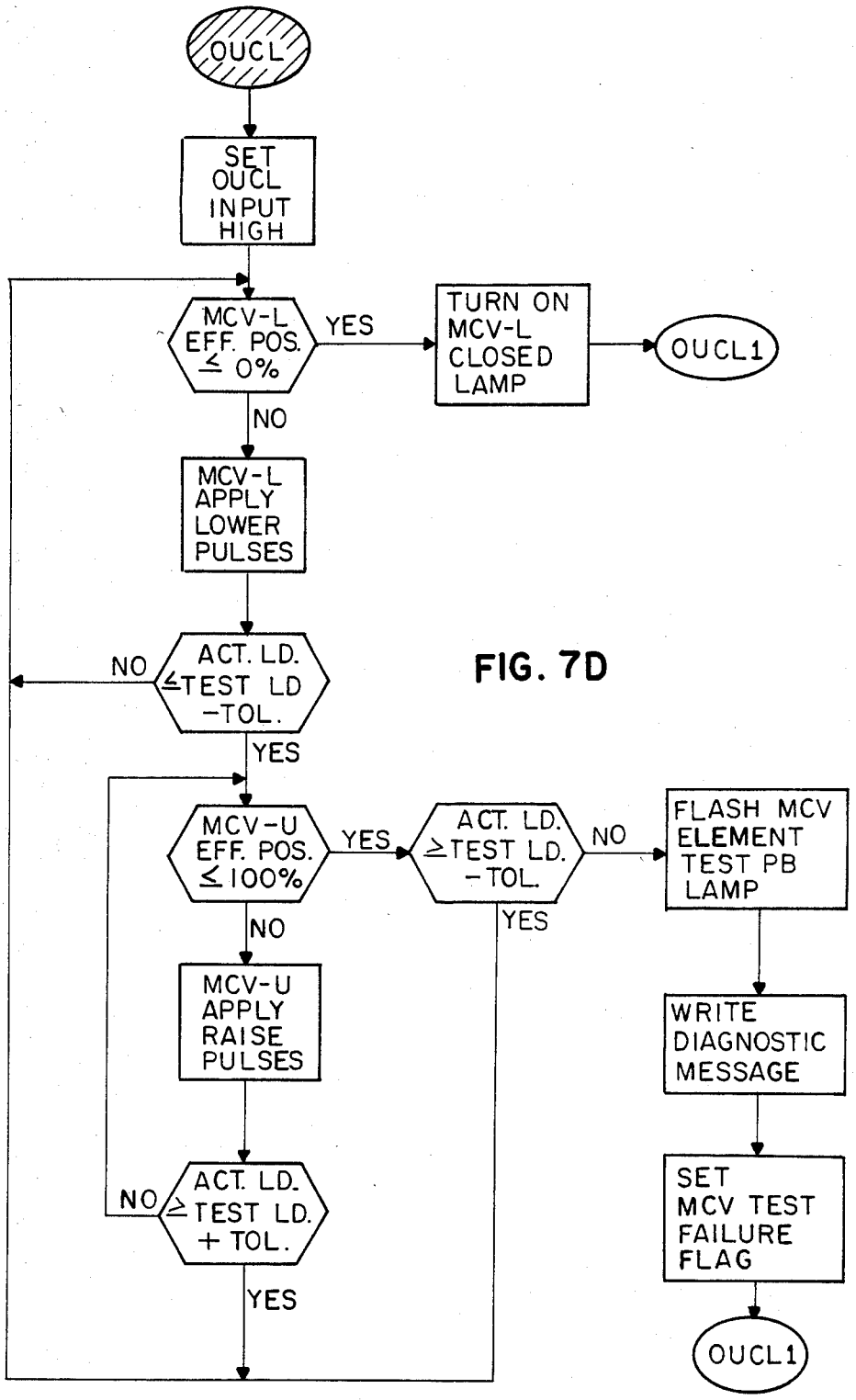
Figure 7E:
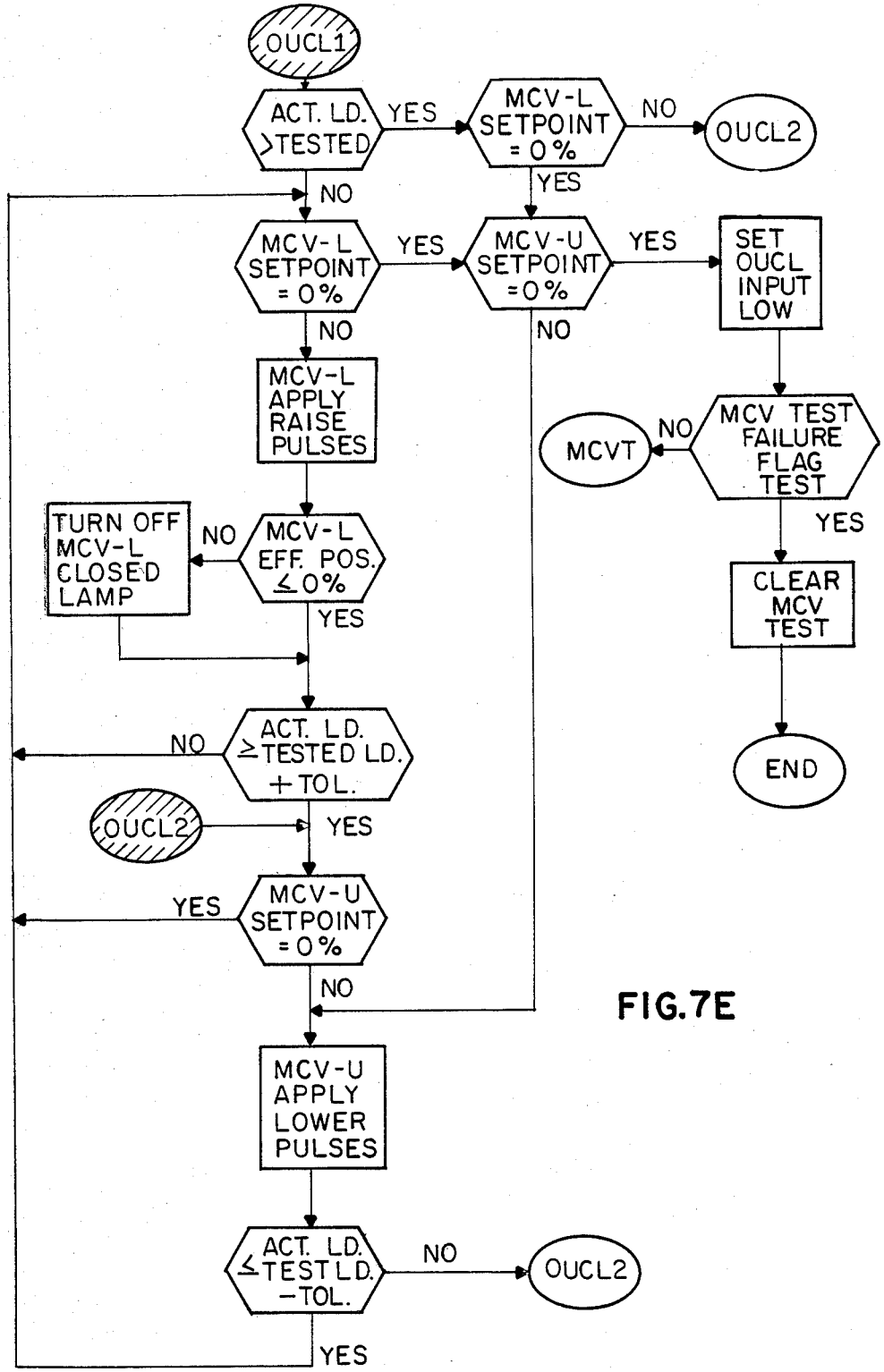

The apparatus of the present invention can be built using any available technology without departing from the scope of the present invention. For example, test controller 68 may be analog or digital apparatus realized using either discrete or integrated components. In the preferred embodiment shown in FIG. 6, turbine control system 38 is preferably a digital device. In the most preferred embodiment, many of the functions of test controller 68 are implemented in a microprocessor. Upper and lower cam controls 28 and 46 may also be actuated by digital or analog devices. In order to take advantage of the availability of proven hardware in performing cam control function, conventional cam controls such as, for example, of the type disclosed in the referenced patent, may be employed as illustrated in FIG. 6. As is conventional, upper main control valves 22, 24 and 26 include position transducers (not shown) to produce electrical signals related to the positions of their respective valves which are fed back to upper cam control 28 on lines 104. Similarly, the positions of lower main control valves 40, 42 and 44 are reported to lower cam control 46 on lines 106.

A watts transducer 108 senses the generator output power for application on line 54 to turbine control system 38 as previously described.

Any convenient sequence of operations may be employed in the digital processor employed in turbine control system 38. An example of one such sequence is shown in the flow charts of FIGS. 7A–7E. Since the flow charts 7A–7E are self-explanatory in the light of the foregoing disclosure, it is presented herein without further discussion.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. Apparatus for testing main control valves in a steam turbine of the type having at least first and second sets of main control valves for admitting steam to said steam turbine and at least first and second cam controls for respectively controlling said first and second sets of main control valves in an actuation sequence, comprising:

first means for driving said first cam control in first a direction which performs one of opening and closing said first set of main control valves and for maintaining said second cam control stationary until a first change in a first predetermined amount in a first direction is achieved in an output of said steam turbine;

second means for driving said second cam control in a second direction which performs the other of opening and closing said second set of main control valves and for maintaining said first cam control stationary until a second change in a second predetermined amount in a second direction opposite to said first direction is achieved in said output of said steam turbine;

said first and second means being effective for alternate actuation until the one of said first and second cam controls performing closing of its respective set of main control valves attains a condition in which its related set of main control valves should be in a predetermined condition; and means for determining whether said related set is, in fact, in said predetermined condition.

2. Apparatus for testing main control valves in a steam turbine according to claim 1 wherein said predetermined condition is a fully closed condition.

3. Apparatus for testing main control valves in a steam turbine according to claim 2 wherein said means for determining includes means for determining whether the condition of the one of said first and second cam controls performing opening is in an appropriate position for a fully closed position of all of said main control valves which should be in the fully closed position.

4. Apparatus for testing main control valves in a steam turbine according to claim 1 wherein said output of said steam turbine is a power output.

5. Apparatus for testing main control valves in a steam turbine according to claim 4 wherein said first predetermined amount is a predetermined decrease in said power output relative to a power output existing at a beginning of said testing.

6. Apparatus for testing main control valves in a steam turbine according to claim 4 wherein said second predetermined amount is a predetermined increase relative to said power output existing at said beginning of said testing.

7. Apparatus for testing main control valves in a steam turbine according to claim 1 wherein said means for determining includes a lookup table relating at least two of a position of said first cam control, a position of said second cam control and said output of said steam turbine.

8. Apparatus for testing main control valves in a steam turbine according to claim 1 wherein said means for determining includes a fluid pressure in an actuator related to at least one of said first and second cam controls.

9. Apparatus for testing main control valves in a steam turbine according to claim 1 wherein at least one of said first means, said second means and said means for determining includes a digital computer.

10. Apparatus for testing main control valves in a steam turbine according to claim 9 wherein said digital computer is a microprocessor.

11. A test controller for testing main control valves in a steam turbine of the type having at least first and second sets of main control valves for admitting steam to said steam turbine and at least first and second cam controls for respectively controlling said first and second sets of main control valves in an actuation sequence, said first and second cam controls including means for independent drive thereof, comprising:

means for storing a test power reference of said steam turbine at a start of a test;

means for producing upper and lower thresholds above and below respectively said test power reference;

logic means for driving said independent drive of said first cam control in a first direction to perform one of opening and closing its related set of main control valves while holding said independent drive of said second cam control stationary until said power output changes an amount to one of exceed said upper threshold and become less than said lower threshold and then for holding said first cam control stationary while driving said independent drive of said second cam control in a second direction to perform the other of opening and closing its related set of main control valves until said power output changes an amount to the other of exceed said upper threshold and become less than said lower threshold;

said logic means being further effective to continue alternately driving said first and second cam controls while maintaining said power output within said upper and lower thresholds until a predetermined condition of said first and second cam controls should be achieved; and means for determining that said predetermined condition is, in fact, achieved.

12. A test controller for testing main control valves in a steam turbine according to claim 11 wherein said predetermined condition includes a closure of all of one of said sets of main control valves.

13. A test controller for testing main control valves in a steam turbine according to claim 11 wherein said means for determining includes a test memory containing baseline data relating at least two of a position of said first cam control and said second cam control and said power output.

14. A test controller for testing main control valves in a steam turbine according to claim 13 wherein said test memory includes a written document.

15. A test controller for testing main control valves in a steam turbine according to claim 13 wherein said test memory includes a look-up table.

16. A test controller for testing main control valves in a steam turbine according to claim 15 wherein said look-up table includes a digitally stored look-up table.

17. A test controller for testing main control valves in a steam turbine according to claim 15 wherein said means for determining includes a display effective to display a comparison of said at least two and said baseline value thereof in said lookup table.

18. A test controller for testing main control valves in a steam turbine according to claim 11 wherein at least said logic means includes a digital processor.

19. A test controller for testing main control valves in a steam turbine according to claim 18 wherein said digital processor includes a test memory containing baseline data relating at least two of a position of said first cam control and said second cam control and said power output.

20. A test controller for testing main control valves in a steam turbine according to claim 19 wherein said test memory includes a look-up table.

21. A test controller for testing main control valves in a steam turbine according to claim 20 wherein said means for determining includes a display effective to display a comparison of said at least two and said baseline value thereof in said lookup table.

22. A test controller for testing main control valves in a steam turbine according to claim 18 wherein said digital processor includes a microprocessor.

23. A method for testing main control valves in a steam turbine of the type having at least first and second sets of main control valves for admitting steam to said steam turbine and at least first and second cam controls for respectively controlling said first and second sets of main control valves in an actuation sequence, said first and second cam controls including means for independent drive thereof, comprising:

storing a test power reference of said steam turbine at a start of a test;

producing upper and lower thresholds above and below respectively said test power reference;

driving said independent drive of said first cam control in a first direction to perform one of opening and closing its related set of main control valves while holding said independent drive of said second cam control stationary until said power output changes an amount to one of exceed said upper threshold and become less than said lower threshold and then holding said first cam control stationary while driving said independent drive of said second cam control in a second direction to perform the other of opening and closing its related set of main control valves until said power output changes an amount to the other of exceed said upper threshold and become less than said lower threshold;

continuing alternately driving said first and second cam controls while maintaining said power output within said upper and lower thresholds until a predetermined condition of said first and second cam controls should be achieved; and determining that said predetermined condition is, in fact, achieved.

* * * * *